US010568446B2

(12) United States Patent
Arza Moncunill et al.

(10) Patent No.: US 10,568,446 B2
(45) Date of Patent: Feb. 25, 2020

(54) DISPENSER-APPLICATOR

(71) Applicants: Alberto Arza Moncunill, Castellon (ES); Roberto Cortes Tanco, Castellon (ES); Eva Garcia Robles, Castellon (ES)

(72) Inventors: Alberto Arza Moncunill, Castellon (ES); Roberto Cortes Tanco, Castellon (ES); Eva Garcia Robles, Castellon (ES)

(73) Assignees: Alberto Arza Moncunill, Castellon (ES); Roberto Cortes Tanco, Castellon (ES)

( * ) Notice: Subject to any disclaimer, the term of this patent is extended or adjusted under 35 U.S.C. 154(b) by 0 days.

(21) Appl. No.: 16/063,127

(22) PCT Filed: Dec. 16, 2016

(86) PCT No.: PCT/ES2016/070901
§ 371 (c)(1),
(2) Date: Jun. 15, 2018

(87) PCT Pub. No.: WO2017/109251
PCT Pub. Date: Jun. 29, 2017

(65) Prior Publication Data

US 2019/0167022 A1 Jun. 6, 2019

(30) Foreign Application Priority Data

Dec. 22, 2015 (ES) ..... 201531864

(51) Int. Cl.
*A47G 19/32* (2006.01)
*A47G 19/18* (2006.01)
(Continued)

(52) U.S. Cl.
CPC ..... *A47G 19/32* (2013.01); *A45D 34/041* (2013.01); *A45D 40/261* (2013.01);
(Continued)

(58) Field of Classification Search
CPC ..... A47G 19/32; A47G 19/183; A47G 19/18; A45D 34/041; A45D 40/261; A45D 34/04;
(Continued)

(56) References Cited

U.S. PATENT DOCUMENTS 2,749,566 A 6/1956 Thomas
2,807,817 A 10/1957 Ackerman
(Continued)

FOREIGN PATENT DOCUMENTS

EP 0712592 A1 5/1996
EP 1591035 A1 11/2005
(Continued)

*Primary Examiner* — David J Walczak
(74) *Attorney, Agent, or Firm* — Hayes Soloway PC

(57) ABSTRACT

Improved dispenser-applicator that includes a container and a closing element, wherein the closing element comprises a sphere and a cap. When placing the sphere on the spout of a container, it closes the container and upon rolling, allows for the outlet of certain quantities of the product to be dispensed. The sphere presents a tread, preferably projected towards the interior of the sphere, and forming zchannels which preferably form ducts, and the cap presents a number of undulations that connect the inner and the outer parts, whilst also allowing for the product to exit through them. The cap that retains the sphere is made of an elastic, deformable material, such that, by exerting a given pressure, it is possible to remove the sphere from the cap.

10 Claims, 4 Drawing Sheets

(51) Int. Cl.

| | |
|---|---|
| ***A45D 40/26*** | (2006.01) |
| ***A45D 34/04*** | (2006.01) |
| ***B65D 43/02*** | (2006.01) |
| ***B65D 47/04*** | (2006.01) |

(52) U.S. Cl.
CPC ..... *A47G 19/183* (2013.01); *B65D 43/0229* (2013.01); *B65D 47/04* (2013.01)

(58) Field of Classification Search
CPC ..... A45D 40/26; B65D 47/00; B65D 47/04; B65D 43/0229; B43K 7/00; B43K 7/10
See application file for complete search history.

(56) References Cited

U.S. PATENT DOCUMENTS

| | | | | | |
|---|---|---|---|---|---|
| 3,235,900 | A | | 2/1966 | Klassen | |
| 3,498,507 | A | * | 3/1970 | Seaver | B65D 47/30 222/486 |
| 3,781,123 | A | * | 12/1973 | Linz | B43K 1/084 401/216 |
| 5,553,957 | A | * | 9/1996 | Dornbusch | A45D 34/041 401/209 |
| 8,192,100 | B2 | * | 6/2012 | Wojcik | A45D 40/261 401/175 |
| 2008/0107475 | A1 | | 5/2008 | Wojcik et al. | |

FOREIGN PATENT DOCUMENTS

| | | | |
|---|---|---|---|
| ES | 452445 | A1 | 1/1978 |
| ES | 260235 | U | 3/1982 |
| ES | 2138062 | T3 | 1/2000 |
| WO | 2008057482 | A1 | 5/2008 |

* cited by examiner

DISPENSER-APPLICATOR

The present invention relates to an improved dispenser-applicator that comprises a container and a closing element, wherein the closing element comprises a sphere and a cap. When placing the sphere on the spout of a container, it closes the container and upon rolling, allows for the outlet of certain quantities of the product to be dispensed.

For better dispensing and application, the present invention combines a sphere that presents treads, preferably projected towards the interior of the sphere, and a cap with a number of undulations that form channels which connect the inner and the outer parts, thereby also allowing for outlet of the product through them.

The invention is preferably conceived to be used in the area of dispensers and applicators of food products, although the use thereof for other applications is not excluded.

The technical field of the invention is the field of dispenser and applicator containers.

BACKGROUND OF THE INVENTION

The roll-on system has been known for decades.

A prototypical device is disclosed in U.S. Pat. No. 2,749,566.

Although dispensers similar to that represented in U.S. Pat. No. 2,749,566 have had widespread commercial acceptance, they present certain disadvantages of use. One of them lies in the relatively small size of the ball, which makes application of the content of the container difficult, especially when, as in this case, the product intended to be applied not only includes liquids, but also more viscous fluids, such as gels, creams, emulsions or sauces, amongst others, as well as fluids that may contain small solids such as seeds, as would be the case with grated tomatoes.

There are other dispensers with rolling spheres that incorporate a number of dividers between the sphere and the inner surface of the cap, which facilitates outlet of the product even when the latter has limited fluidity, as in the case of cosmetics and hygiene products.

This is the case of Spanish patent of invention ES452445, which relates to a sphere with a smooth surface housed in a cap whose inner wall shave a number of protrusions that support the sphere and act as dividers, thereby generating a passage way between the sphere and the walls of the cap, and favouring passage of the product.

Another proposed solution is reflected in patent ES2138062, which arises from European patent EP0712592, wherein the rolling sphere is pressed against the upper spout of the cap by elastic elements, such that the container is closed due to the complementary geometries, as said elastic elements that push the sphere against the spout of the cap may be easily brought down, thereby allowing for recoil of the sphere and, consequently, outlet of the product.

There are other solutions designed to favour the outlet of the product that use a cap with protrusions which may even configure a number of channels; in this regard, the following are worth mentioning:

- ES260235U, related to a dispenser of the type that comprises a rolling sphere with a smooth surface housed in a cap, said cap comprising protrusions in its inner side that are suitable to maintain a certain distance between the sphere and the cap, thereby allowing for outlet of the product.
- ES452445 relates to a dispenser of the type that comprises a rolling sphere with a smooth surface housed in a cap that presents protrusions in its inner side, in order to maintain the sphere away from the cap, thereby allowing for outlet of the carrier; in this case, the sphere presents a certain span between two retaining rings, such that it acts as a valve that opens and/or closes the product container.
- EP1591035, relating to a dispenser of the type that comprises a rolling sphere housed in a cap and protrusions in the inner side of the cap; in this case, magnetic solutions are used to contribute to controlling the dispensing.
- WO 2008/057482 claims a dispenser of the type that comprises a rolling sphere with a smooth surface housed in a cap that presents a plurality of channels in its inner side, in order to facilitate outlet of the product from the interior of the container, the outlet being favoured by a piston system incorporated in the container.
- ES260235U relates to a dispenser of the type that comprises a rolling sphere housed in a cap, and this utility model proposes two alternative executions, since, in order to guarantee separation between the cap and the sphere, it envisages an execution example wherein the inner wall of the cap presents ribs that make up channels, with the sphere having a smooth surface, and a second, alternative execution, wherein the inner walls of the cap are smooth, but the surface of the sphere presents protrusions that act as dividers between the cap and the sphere, thereby allowing for passage of the product.

None of the aforementioned patents or utility models propose a dispenser wherein the cap presents a number of grooves and, at the same time, the sphere presents a surface with treads which, in turn, may form channels; this is due to the fact that, when two surfaces, that of the sphere and that of the inner side of the cap, come in contact or create friction between them, if both of them have treads, they tend to engage with one another and, consequently, the device loses all its efficacy.

However, for the types of products intended to be dispensed, which comprise viscous fluids such as gels, creams, emulsions, sauces or even some crushed vegetables, such as tomatoes, that may have seeds, it is necessary to have joint operation of channels which allow for outlet of the product and a rolling sphere which, on the one hand, contributes to outlet of the product and, on the other hand, applies it on the target surface, for example, as in this case, the surface of a toast.

In order to apply the product, a certain tread is also necessary on the sphere, such that the sphere grips the surface of the target, which may be, for example, a slice of toasted bread, thereby generating sufficient friction to force pivoting of the sphere.

DESCRIPTION OF THE INVENTION

The invention relates to a dispenser that comprises a closing element which, in turn, comprises a spherical body and a cap that houses and retains it, but leaves sufficient clearance to allow for pivoting of said spherical body, all of it associated with a deformable container that makes it possible for the user to aim the product content against the closure.

"Spherical body" is understood to mean both spheres and spheroidal bodies, although in the case of the latter, the moving capacity of a spheroid inside a cap is more limited than in the case of spheres.

The dispenser comprises:

1. A closing element which, in turn, comprises:
   a. A spherical body, which we will call "sphere", housed in said cap, the spherical body presenting treads on the surface thereof and these treads being preferably oriented towards the interior of the sphere.
   b. A cap whose inner geometry has the shape of a spherical core or spheroid, and whose inner surface presents a number of undulations with variable geometry radii between peaks and troughs of the waves, which we will refer to as "undulations".
2. A deformable container.

1.— The purpose of the closing element is to retain the product inside the container, thereby preserving it against external agents, such that, when pressure is exerted on the product, since the container is deformable, there is a homogeneous outlet of the product around the sphere which facilitates the application thereof.

To this end, the closing element comprises a sphere and the cap, as explained in depth below:

1.a) The Sphere:

The sphere is a body with, in general, a spherical or spheroidal shape, notwithstanding the treads or channels that the surface thereof may present.

It is housed in the cap, wherein it is retained due to the complementary geometries, but has sufficient clearance to allow for pivoting of the sphere inside the cap.

It presents a number of treads projected towards the interior, preferably forming ducts, which we will call "sphere channels".

The sphere channels are preferably distributed throughout the surface of the sphere in a uniform manner.

They may be arranged in various ways; as an example:

Parallel arrangement, like the earth's parallels.

Meridional arrangement, converging at the poles of the sphere like the earth's meridians.

Spiral arrangement, tracing a spiral that runs throughout the surface of the sphere.

In the case of the meridional arrangement, the areas of the sphere where the channels converge, which we will call "poles", preferably present a smooth surface that favours pivoting of the sphere inside the cap, thereby preventing the sphere channels and the undulations on the cap from engaging with one another.

A combination of two or more arrangements, or even random arrangements, may be used, although the behaviour may be compromised either because the pivoting or the capacity to dispense or apply the product are hindered.

The term "channels" refers to any tread on the surface of the sphere, whether or not it is in the form of ducts.

In order to favour the pivoting without the sphere channels engaging with the undulations on the cap, the sphere channels or the peaks of the undulations on the cap, or both, present rounded edges.

1.b) The Cap:

The cap is an element which, amongst other things, embraces the sphere, partially housing it and retaining it due to the geometry, whilst leaving sufficient clearance to allow for the pivoting thereof, contributes to a homogeneous outlet of the product thanks to the perimetral undulations on its inner surface, and incorporates media that collaborate towards the anchoring of the closing element to the container.

To this end, the cap presents a ring shape, with three clearly defined areas:

An outer spout, through which part of the sphere protrudes.

In the inner portion of its central area, a hollow spherical core which partially houses the sphere.

A flap that incorporates anchoring the cap to the container.

The cap partially houses the sphere in its central hole, which has the form of a spherical core, allowing for part of the sphere to protrude through the outer spout.

Given the geometry of the spout, the sphere is retained in the central hole, although with sufficient clearance to allow for easy pivoting thereof.

The central hole presents a lower opening connected to the container which, also due to its geometry and dimensions, retains the sphere on the lower side.

The central hole presents an inner surface crossed by a number of undulations, which end on the outer spout of the cap.

Contact between the sphere and the cap essentially takes place in this central hole, the inner geometry whereof is a spherical core and which houses the sphere.

The flap incorporates anchoring elements for anchoring the closure to the container, these anchoring elements habitually collaborating with those found in the container.

For constructive purposes, the cap is preferably made of a flexible material susceptible to deformation, in order to remove the sphere when a pressure greater than that necessary to force outlet of the product is applied.

Removal of the sphere facilitates washing and re-using the dispenser.

However, there may be other ways to build the cap; for example, it may be made of two or more parts with joining elements between them, such that the cap may be disassembled in order to remove the sphere.

2.— The deformable container.

"Deformable container" will be understood to mean any container the capacity or distribution whereof may be changed in such a way that the user may aim its content and press it against the closure by controlling the pressure exerted.

In general, these will be containers made of plastic or silicones, amongst other materials which allow for squeezing, although embodiment of the invention with other types of containers made of more rigid materials is not excluded, provided that they may be folded, that one part of the container may be embedded inside another or that the inner capacity thereof may be altered in any other way, such that the product contained may be aimed against the closing element.

When the user deforms the container, the improved dispenser-applicator described above allows for the product contained to flow to the exterior through the undulations on the cap and the sphere channels.

Moreover, the sphere acts as an applicator when it rolls on the target surface, which may be a toast, a sponge cake, a hamburger, a steak or any other foodstuff whereto one wishes to add a fluid supplement, such as a sauce, a cream, a gel or an emulsion, amongst others.

The sphere will roll when the friction generated by the target surface is greater than the friction al resistance generated between the sphere and the cap.

The presence of channels on the surface of the sphere facilitates the grip of the sphere onto the target surface, thereby contributing to increasing the friction.

A lid may be used to cover the ensemble, for better preservation of the product when it is not in use.

BRIEF DESCRIPTION OF THE FIGURE S

FIG. 1 shows the closing element (1) and the sphere (2) which partially protrudes from the cap (3). In this FIGURE, the sphere presents a meridional arrangement, and it shows the sphere channels (4) converging at a pole (5) that presents a smooth area. In the cap, we may observe the flap with the anchoring elements (6), in this case the threads.

DESCRIPTION OF AN EMBODIMENT OF THE INVENTION

Figure 1:
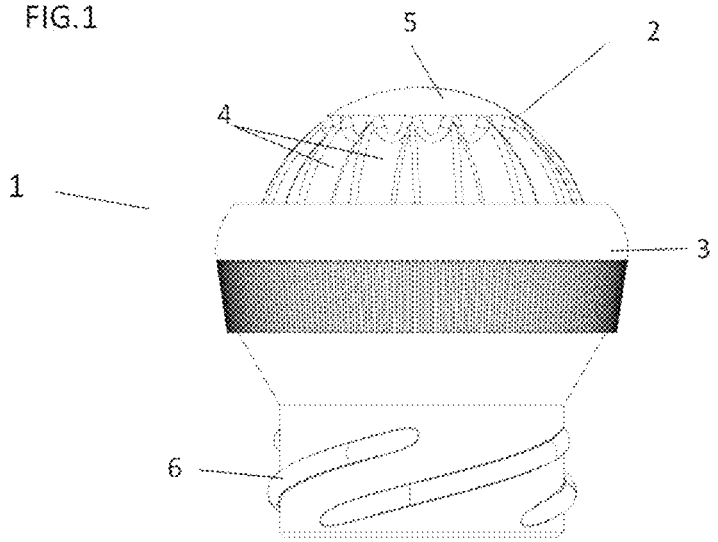
Figure 2:
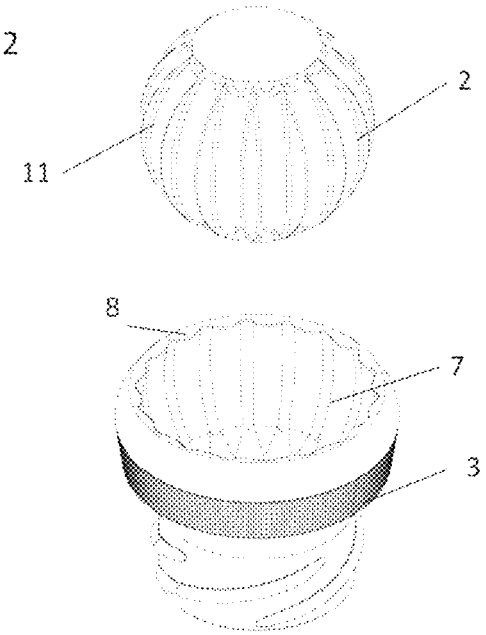
FIG. 2 is an exploded view of the closure, which shows the cap (3) and the sphere (2). In this FIGURE, we may observe the undulations on the cap (7), the peaks whereof are rounded (8), and the sphere channels (4), the edges (11) whereof also have a rounded shape.
Figure 3:
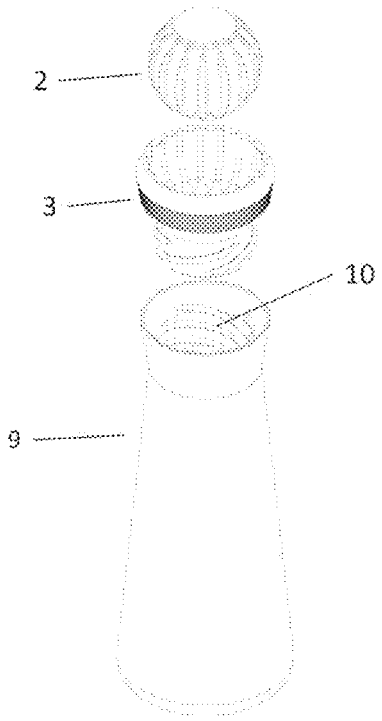
FIG. 3 is an exploded view of the dispenser-applicator, which shows the sphere (2), the cap (3) and the container (9), with anchoring elements that collaborate (10) with those present in the cap.
Figure 4:
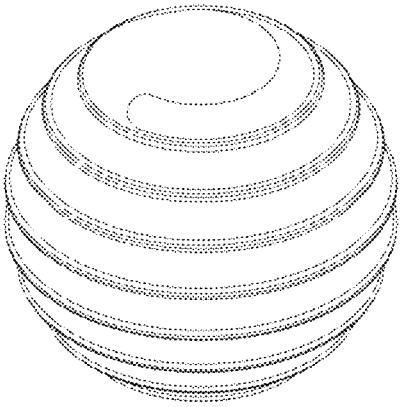
FIG. 4 shows an alternative embodiment of the sphere, in this case with a channel that runs through the surface thereof in spiral form.
Figure 5:
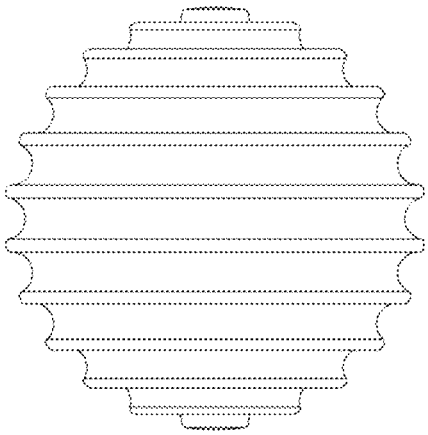
FIG. 5 shows an alternative embodiment of the sphere, in this case with channels arranged in parallel.

Here is detailed an embodiment of the invention, which is not unique but only explanatory.

The invention relates to a fluid dispenser-applicator, for both viscous fluids, such as mayonnaise, sauces, emulsions or creams, and others that may present small solid parts, such as, for example, grated tomatoes or other vegetables.

The invention relates not only to a container that presents a closing element which retains the product in the interior thereof, but to one wherein the same closing element dispenses it and applies it on the target surface, which, in the field of food, may be a toast, a sponge cake or a steak.

The dispenser—applicator comprises:

1. A closing element which, in turn, comprises a cap with undulations and a sphere with channels that form ducts, such that the sphere is partially exposed to an outside of the cap, but, due to its geometry, is retained by the cap, with sufficient clearance to allow for the pivoting thereof
2. A deformable container joined to the closure.

The cap has three differentiated areas:

A spout that is open to the outside and through which the sphere partially protrudes, but which, in turn, retains it, preventing it from falling off during normal usage.

A central area that partially houses the sphere and presents an inner surface with a number of undulations that run through it, ending on the spout of the cap, these undulations generating channels that connect the lower part, or flap, to the spout of the cap.

A flap that incorporates anchoring elements which collaborate towards anchoring the closing elements to the container.

The cap, with the sphere inserted therein, retains the product inside the dispenser, thereby preventing the involuntary outlet thereof.

When pressure is exerted on the product, which is possible as the container is deformable, the product presses against the closing element and is released, at least, through the channels formed by the undulations on the cap, and it may also be released through the sphere channels, depending on the pivot point of the latter.

Since the undulations on the cap are perimetrally and uniformly arranged, the product is homogeneously dispensed.

When it pivots on the target surface, such as a toast, the sphere applies and distributes the dispensed product, and it may also dispense the product by itself or, in any case, allow for the inlet of air in order to prevent the pressure difference from hindering the outlet of the product, as well as to facilitate recovery of the shape of the container.

The cap is made of an elastic, deformable material, such that, by exerting a certain pressure, the sphere is removed from the cap, which facilitates cleaning of the closing element. The pressure to be exerted in order to remove the sphere from the cap is necessarily greater than the pressure exerted to dispense the product.

In order to facilitate the pivoting and to prevent the sphere channels from engaging with the peaks of the undulations on the cap, the edges of the channels have a rounded shape and, when the execution proposed is that wherein the sphere channels are in a meridional arrangement, the sphere presents an area with a smooth surface at the points, on both ends, where the channels converge.

The friction between the sphere and the cap is minimal, since the points of contact are the outer parts of the channels, which minimises the friction and favours the pivoting.

The anchoring between the closure and the container may be performed in numerous ways, and here we have chosen threading, due to its simplicity and its reliability for achieving strong, easily removable junctions.

The container is deformable, and in this case is made of a soft material, such as silicone or a similar material, such that, by simply squeezing the container, the user may control the pressure desired depending on the quantity of product to be dispensed.

The invention claimed is:

1. An improved dispenser-applicator that comprises a closing element and a container, wherein the closing element comprises a sphere and a cap, wherein the sphere is partially housed in the cap, wherein the cap retains the sphere and allows for the pivoting of the sphere and also allows for a part of said sphere to be exposed to an outside of the cap, wherein the sphere comprises sphere channels including treads on a surface of the sphere and the cap presents a number of undulations on an inner surface of the cap wherein the undulations comprise a plurality of peaks that present rounded edges and the container is deformable.

2. The improved dispenser-applicator of claim 1, wherein the treads project towards the interior of the sphere.

3. The improved dispenser-applicator of claim 1, wherein edges of the sphere channels are rounded.

4. The improved dispenser-applicator of claim 1, wherein the sphere channels form ducts.

5. The improved dispenser-applicator of claim 1, wherein the sphere channels present a meridional arrangement.

6. The improved dispenser-applicator of claim 1, wherein the sphere channels are arranged in parallel with respect to one another.

7. The improved dispenser-applicator of claim 1, wherein the sphere channels present a spiral arrangement.

8. The improved dispenser-applicator of claim 1, wherein the cap is made of an elastic material.

9. The improved dispenser-applicator of claim 1, wherein the cap presents anchoring elements for anchoring the cap to the container.

10. The improved dispenser-applicator of claim 1, wherein the undulations on the cap additionally comprise troughs and the undulations present variable geometry radii between the peaks and the troughs of the undulations.

* * * * *